US006000549A

United States Patent [19]

Perkins

[11] Patent Number: 6,000,549

[45] Date of Patent: Dec. 14, 1999

[54] BULK CONTAINER

[75] Inventor: David W. Perkins, Hiawatha, Iowa

[73] Assignee: Paper Systems, Inc., Des Moines, Iowa

[21] Appl. No.: 09/132,190

[22] Filed: Aug. 11, 1998

[51] Int. Cl.[6] ..... B65D 81/02

[52] U.S. Cl. ..... 206/596; 206/600; 220/495.03; 220/666; 229/117.27

[58] Field of Search ..... 206/600, 386, 206/503, 320, 326, 596, 597, 599; 220/1.6, 495.03, 495.05, 495.06, 23.91, 315, 666, 459.01; 229/117.3, 117.35, 117.27

[56] References Cited

U.S. PATENT DOCUMENTS

| | | | |
|---|---|---|---|
| 3,529,717 | 9/1970 | McDougal | 206/598 |
| 3,896,991 | 7/1975 | Kozlowski et al. . | |
| 4,054,223 | 10/1977 | Marques | 220/4 |
| 4,359,182 | 11/1982 | Perkins, Jr. . | |
| 4,392,607 | 7/1983 | Perkins, Jr. . | |
| 4,421,253 | 12/1983 | Croley | 22/105 |
| 4,614,277 | 9/1986 | Fourie et al. | 108/51.1 |
| 4,850,506 | 7/1989 | Heaps, Jr. et al. | 220/403 |
| 4,901,885 | 2/1990 | Boots . | |
| 4,903,859 | 2/1990 | Derby et al. . | |
| 5,069,338 | 12/1991 | Grigsby | 206/319 |
| 5,069,359 | 12/1991 | Liebel | 220/441 |
| 5,188,460 | 2/1993 | Dorse | 383/18 |
| 5,348,186 | 9/1994 | Baker | 220/465 |
| 5,353,982 | 10/1994 | Perkins et al. . | |
| 5,562,229 | 10/1996 | Callahan | 220/460 |
| 5,813,562 | 9/1998 | Perkins | 220/495.05 |

*Primary Examiner*—Paul T. Sewell
*Assistant Examiner*—Nhan T. Lam
*Attorney, Agent, or Firm*—Zarley, McKee, Thomte, Voorhees & Sease

[57] ABSTRACT

A container includes a flexible liner for holding fluent material, a plurality of substantially vertical rigid support walls spaced around the periphery of the liner, and a flexible skin interconnecting the walls and encircling the liner so as to laterally constrain and support the liner when fluent material is added. The container can include a bottom wall under the liner and connected to some of the support walls. Furthermore, a top platform can be removably secured over the liner so as to rest on top of the support walls. This provides the strength and rigidity to make the container system stackable. The support walls can be removably disposed in pockets or a sleeve in the flexible skin.

21 Claims, 1 Drawing Sheet

BULK CONTAINER

BACKGROUND OF THE INVENTION

The present invention relates to bulk containers for flowable materials including, but not limited to, fluids. More particularly, this invention relates to a unique flexible bulk container system which is stackable both in use and in storage and is collapsible to facilitate more compact storage.

Handling flowable or fluent materials in bulk is difficult because of the weight of the material and the bulk of the container. Warehouse and in-transit storage space is often scarce and expensive. Various containers have been developed to address this handling problem. For instance, many existing container systems utilize a rigid frame, a drum, or a rigid frame with a flexible, fluid impervious liner. Some of these rigid containers can even be stacked to save space. However, these container systems are bulky, requiring considerable storage space whether they are full or empty. Such container systems are also quite heavy, whether full or empty. In an effort to reduce weight and cost, some container manufacturers have tried corrugated cardboard container walls, but the cardboard walls are not strong enough to withstand the high compression loads of stacking. Furthermore, the cardboard deteriorates if exposed to moisture.

Therefore, a primary objective of the present invention is the provision of an improved bulk container system.

Another objective of this invention is the provision of a container system that is collapsible when not in use.

Another objective of this invention is the provision of a container system with an outer body or frame that includes some flexible side walls and some rigid side walls, such that the outer body foldingly collapses for storage.

Another objective of this invention is the provision of a container system that can be stored on or incorporated with a standard wooden shipping pallet.

Another objective of this invention is the provision of a container system that is lightweight, strong, waterproof, durable and yet stackable.

Another objective of this invention is the provision of a container system that utilizes rigid support walls removably disposed in pockets in some, but not all, sides the outer body.

Another objective of this invention is the provision of a container system that is shaped like an octagon in a horizontal plane so as to allow a relatively large volume of material to be stored in a given space, utilizing a round of cylindrical liner.

Another objective of this invention is the provision of a container system that is economical to produce, easy to use and repair, and reliable.

These and other objectives will be apparent from the drawings, as well as the description and claims which follow.

SUMMARY OF THE INVENTION

The present invention relates to a container for fluent material. The container includes a flexible liner for holding the fluent material, a plurality of substantially vertical support walls spaced around the periphery of the liner, and a flexible skin interconnecting the walls and encircling the liner so as to laterally constrain and support it when fluent material is added.

The container can include a bottom wall under the liner and connected to some of the support walls. Furthermore, a top platform can be removably secured over the liner so as to rest on top of the support walls. This provides the strength and rigidity to make the container system stackable. The support walls can be removably disposed in pockets or a sleeve in the flexible skin.

The container system of this invention is flexible and lightweight. The container can be removably secured to a standard wooden pallet, and the resulting unit can be stacked for more efficient use of storage space. The unit easily breaks down, with the container being foldingly collapsible, even with the support walls in place.

DETAILED DESCRIPTION OF THE PREFERRED EMBODIMENT

Figure 1:
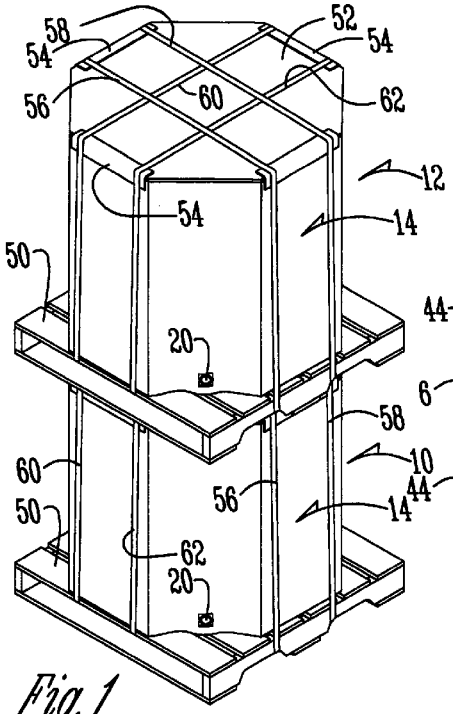
FIG. 1 is a perspective view of bulk container system of this invention.
Figure 2:
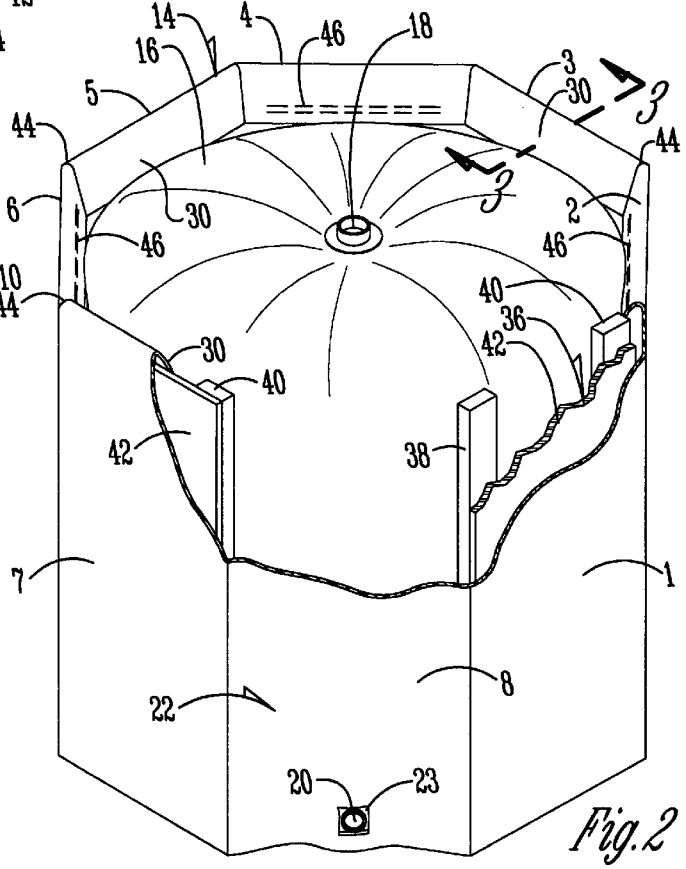
FIG. 2 is a perspective view illustrating the construction of the bottom container shown in FIG. 1. The other container(s) stacked thereon share the same common structure as shown in FIG. 2.
Figure 3:
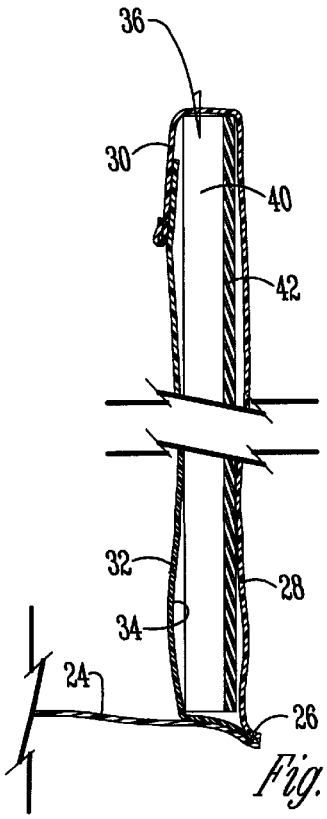
FIG. 3 is a sectional view of the outer body of the container taken along line 3—3 in FIG. 2.

FIG. 1 shows two container systems 10, 12 of this invention stacked on top of each other for storage or transport. FIG. 2 shows the construction of the container 14 which is the main component of the flexible stackable container system 10, 12. The container 14 includes a removable flexible liner 16 having an inlet opening with a top cap 18 and a drain or outlet opening with a threaded plug 20 therein. Of course, the liner 16 is empty when first inserted into the outer body skin 22. However, when filled it has a horizontal periphery. Polyethylene liners are known to perform well in holding nonhazardous fluent materials. As best seen in FIG. 3, the container 14 further includes a bottom 24 joined along a seam 26 with an outer skin 28. The outer skin 28 includes a top flap 30 which overlaps an inner skin 32 that is joined to the bottom 24 and the outer skin 28 along seam 26. This forms a sleeve with an upwardly directed opening therein 34 between the inner and outer skins 28, 32. In addition to the substantially horizontal seam 26, vertical seams can be added so that the sleeve 34 comprises a plurality of pockets. A woven polypropylene fabric-like material is preferred for the bottom 24, as well as for inner and outer skins 28, 32. At least the outer skin 28 should be coated to waterproof the skin so the container can be stored indoors or outdoors.

As shown in FIG. 2, a plurality of rigid support walls 36 are inserted into the sleeve 34 or pockets at spaced intervals circumferentially around the liner 16. The support walls 36 include a pair of horizontally spaced upright members 38, 40 and a substantially rigid wall member 42 which extends between the upright members 38, 40 and is attached to them. The wall member 42 and the upright members 38, 40 are made of wood, but other strong and lightweight materials cold be used without detracting significantly from the invention. To store up to 200–400 gallons in the container, a one-half inch thick particle board wall member 42 and 1 inch by 4 inch pine upright members 38, 40 will suffice.

In the preferred embodiment, an octagonal outer body skin 22 is formed around the liner 16 by inserting the support walls 36 into the sleeve 34 or pockets on the odd numbered sides 1, 3, 5 and 7. The flap 30 is folded over the support walls 36 until it overlaps the inner skin 32. Folds, seams or slits 44 are provided along the flap 30 to allow it to lay flat. The seams 44 may extend all the way to the bottom 24. Along the even-numbered flexible sides 2, 4, 6 and 8, the flap 30 can be secured to the inner skin 32 along a seam 46 by glue, stitching, or other suitable means of securement.

Figure 4:
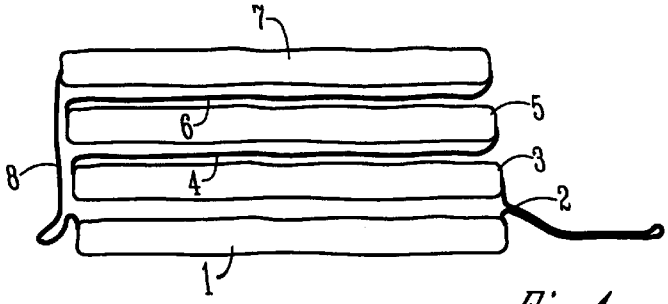
FIG. 4 is a front elevation view of the outer body of the container of FIG. 3 in a folded condition for storage or transport when the container is empty. The vertical spacing is exaggerated slightly to better show the flexible sides or sections interconnecting the support walls.

FIG. 4 illustrates that the container 14 can be collapsed when the liner 16 is empty or removed. The user merely folds the sides of the container 14 inwardly upon each other until the compact rectilinear structure shown results. This structure is compact, lightweight, and easily storable or transportable. Other methods of folding the container 14, with or without the rigid support walls being removed, are contemplated and would be obvious to those skilled in the art after studying the drawings and this description.

It is contemplated that the bottom 24 may not be necessary, as the container 14 can be placed on a sufficiently supportive pallet 50 prior to inserting and filling the liner 16.

As best seen in FIG. 1, a conventional wooden pallet 50 can be positioned in supporting or load bearing relation under the liner 16 of the container 14. Thus, the outer body skin 22 and the support walls 36 contained therein rest on the pallet 50. A substantially rigid top platform 52 is placed on top of the container 14. The platform 52 rests on at least some of the vertical support walls 36. Corner protectors 54 (preferably made of cardboard) mount on some edges of the platform 52 as shown, preferably over the support walls 36. Then the user can secure the top 52 to the container 14 and the container 14 to the pallet 50 with a plurality of flexible strapping bands 56, 58, 60 and 62. Once the bands 56–62 are tightened and locked, the container 14 and pallet 50 move as an integrated unit. Thus, the units can be stacked on top of each other as shown in FIG. 1. FIG. 1 shows the containers 10, 12 stacked two units high; however, it is possible that the units could be stacked even higher. It is important that the support walls 36 be positioned directly over each other for optimum results. The upright members 38, 40 carry the bulk of the compressive load. Advantageously, the force or pressure of the flowable material in the liner pushes outwardly with substantially equal force on all of the support walls 36. Thus, the filled liner 16 actually hydraulically stabilizes or "hydrostabilizes" the support walls 36, keeping them vertical and rigid for stacking purposes.

In use, the collapsed container 14 is unfolded from the storage position shown in FIG. 4. The container 14 is placed on a supporting surface, such as the pallet 50 and arranged in its octagonal configuration, as shown in FIG. 2. The empty liner 16 is placed inside the loop of the outer body skin 22 with the inlet opening or top cap 18 up and the drain opening plug 20 registered with the aperture 23 provided in the outer body skin 22. Next the user fills the liner 16 with the fluent material, then replaces the top cap 18. If the container 14 is to be stacked, the user will apply the top platform 52 and the bands 56–62, but these items are optional in non-stacking applications.

Of course, the width of the flexible sides 2, 4, 6 and 8 can be varied. However, the widths of sides 2, 4, 6 and 8 should be at least as great as the widths of the corresponding adjacent sides 1, 3, 5 and 7 to provide the greatest collapsibility. It is contemplated that one or two flexible sides of sufficient width would still allow the container sides to be folded and collapsed for more compact storage.

The bulk container of this invention efficiently stores and facilitates handling of nonhazardous liquids, including, but not limited to, tomato paste, purees, and concentrates. One person can assemble the container system in about a minute. The container is hydrostabilized so no horizontal banding is required. Furthermore, this container system weighs 70 percent less than similar conventional bins. This container system also saves freight costs whether the container is full or empty (broken down).

Therefore, the present invention at least achieves its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A stackable collapsible container for storing flowable materials comprising:

an outer body having a plurality of substantially vertical side walls joined together to form a continuous loop, at least some of the side walls being rigid and at least other of the side walls being flexible;

a liner constrained by the side walls within the loop and adapted to hold flowable material;

a substantially rigid top platform extending over the liner and resting on at least some of the rigid side walls so as to distribute a compression load among said at least some of the rigid side walls; and means detachably securing the top platform to the outer body;

whereby the outer body can be detached from the top platform, collapsed, and folded for storage when the liner is empty; and whereby the container also can be stacked when the liner is filled with flowable material, the flowable material bearing with an equal pressure on all of the side walls of the outer body so as to keep the side walls vertical and rigid for stacking.

2. The container of claim 1 comprising a pallet for supporting the liner in a vertical direction, the pallet being detachably secured to the outer body by the means detachably securing the top platform to the outer body.

3. The container of claim 2 wherein the means for securing extend around the both the top platform and a portion of the pallet.

4. The container of claim 1 wherein the means for securing comprise at least one flexible strapping band.

5. The container of claim 1 wherein the liner is removable from the outer body.

6. The container of claim 1 wherein the outer body has a bottom wall connecting at least some of the side walls.

7. A stackable collapsible container for storing flowable materials comprising:

an outer body having a plurality of substantially vertical side walls joined together to form a continuous loop, at least some of the side walls being rigid and at least other of the side walls being flexible;

a liner constrained by the side walls within the loop and adapted to hold flowable material;

a substantially rigid top platform extending over the liner and resting on at least some of the rigid side walls so as to distribute a compression load among said at least some of the rigid side walls; and means detachably securing the top platform to the outer body;

whereby the container can be stacked when the liner is filled with flowable material, the flowable material bearing with an equal pressure on all of the side walls of the outer body so as to keep the side walls vertical, stabilized, and rigid for stacking.

8. A container for fluid material comprising:

a collapsible outer skin member comprising four opposing rigid vertical side walls arranged in perpendicular pairs and four flexible vertical side walls constructed of a flexible material, the flexible vertical side walls alternating with and being joined to the rigid side walls to define an octagonal open top;

the rigid side walls each including a pocket formed on the outer skin member and a rigid support wall slidably inserted into the pocket;

the pocket comprising a pocket flap joined to the outer skin member along a bottom seam and spaced apart generally vertical side seams to form an upwardly directed top opening of the pocket; and a removable liner for holding fluid material disposed inside the outer skin member, the liner having a top fill opening accessible through the octagonal open top of the container without moving the outer skin;

whereby the flexible side walls are made taut by fluid filling the liner such that the rigid support walls are held in place and the container is self-stabilizing during and after filling.

9. The container of claim 8 wherein the rigid support wall comprises a substantially planar plate member that has upper and lower edges completely disposed inside the pocket.

10. The container of claim 9 wherein the pocket flap is constructed of a flexible material and the upper edge of the rigid support wall is covered by one of the outer skin member and the pocket flap being folded thereover.

11. The container of claim 8 wherein the pocket is disposed between the outer skin member and the liner.

12. The container of claim 8 wherein the flexible side walls and the rigid support walls have a common width such that the octagonal open top has a regular octagonal perimeter.

13. The container of claim 8 where the outer skin member has a bottom wall interconnecting the rigid and flexible vertical side walls, the connection of the bottom wall and the rigid side walls defining the bottom seal of the pocket, the bottom wall being adapted to rest under the liner.

14. The container of claim 8 comprising a pallet positioned in load bearing relation under the liner and the rigid support walls.

15. The container of claim 14 wherein the pallet is removably secured to the rigid support walls by flexible strapping bands.

16. The container of claim 8 comprising a substantially rigid platform removably secured over the liner so as to rest on top of the rigid side walls.

17. The container of claim 8 wherein the outer skin member has an outer surface that is impervious to fluid materials.

18. The container of claim 8 wherein the liner has a lower portion with a sealable outlet opening formed therein and the one of the flexible side walls has an access aperture therein registered with the outlet opening.

19. the container of claim 8 wherein the outer skin member has a top flap thereon comprising a plurality of top flap portions each being registered with one of the support walls and being folded inwardly thereover to at least partially cover the upwardly directed top opening of the pocket and completely cover the respective support wall.

20. The container of claim 8 wherein the flexible vertical side walls are of sufficient width between the support walls such that, when the liner is empty, at least some of the flexible side walls fold completely across the support walls adjacent thereto and thereby the support walls fold toward each other and stackingly register with each other to form the collapsible outer skin member into a rectangular stack.

21. The container of claim 8 wherein the rigid support walls each comprise a substantially rigid plate member having vertical opposing planar surfaces and vertical sides edges, a first reinforcing bar member being attached to the one of the planar surfaces adjacent one of the side edges and a second reinforcing bar member being attached to said one of the planar surfaces adjacent to the other of the sides edges.

* * * * *